US005083788A

United States Patent [19]

Conotter

[11] Patent Number: 5,083,788

[45] Date of Patent: Jan. 28, 1992

[54] THREE-DIMENSIONAL PUZZLE

[76] Inventor: Luciano Conotter, Via SS. Cosma e Damiano, 34 I-38100, Trento, Italy

[21] Appl. No.: 534,490

[22] Filed: Jun. 6, 1990

Related U.S. Application Data

[63] Continuation-in-part of Ser. No. 447,245, Dec. 7, 1989.

[30] Foreign Application Priority Data

Jun. 7, 1989 [WO] World Int. Prop. O. ... DM/013 750

[51] Int. Cl.[5] ..... A63F 9/08

[52] U.S. Cl. ..... 273/153 S; 273/155

[58] Field of Search ..... D21/104, 107; 273/153 R, 153 S, 155

[56] References Cited

U.S. PATENT DOCUMENTS

| | | | |
|---|---|---|---|
| D. 274,074 | 5/1984 | Brunko | D21/107 |
| 4,949,969 | 8/1990 | Johnson | 273/153 S |

FOREIGN PATENT DOCUMENTS

| | | | |
|---|---|---|---|
| 1199351 | 1/1986 | Canada | 273/153 S |
| 2549381 | 1/1985 | France | 273/153 S |
| 1319887 | 6/1987 | U.S.S.R. | 273/153 S |
| 1319888 | 6/1987 | U.S.S.R. | 273/153 S |
| 2107997 | 5/1983 | United Kingdom | 273/153 S |

OTHER PUBLICATIONS

"Pyramix Puzzles", Hong Kong Toys, Meffert Novelties, 1982.

*Primary Examiner*—Edward M. Coven
*Assistant Examiner*—William M. Pierce
*Attorney, Agent, or Firm*—Horst M. Kasper

[57] ABSTRACT

The three-dimensional puzzle extends over the side surfaces of an upright prism having a polygonal base surface. The puzzle is composed of at least two parts (A, B) which are coaxially rotatable (a) relative to each other. The rotation (a) can be manually performed in both directions and each corresponding position of the side faces is marked by a locking engagement between the two parts (A, B). Plaques (1) are slidably (v, h) disposed in a vertical double row on each side face. These plaques (1) cover the full side face. These plaques (1) exhibit on their back side elastic wings (1*a*) extending and protruding from a connection pin (1*b*) disposed in the center of the plaque (1). The plaques (1) are slidable at the side faces of the prism in a vertical direction (v) and/or horizontal direction (h) and are held in position with the elastic wings (1*a*) guided in guide grooves (2). The plaques (1) and elastic wings (1*a*) are slidable to that side face of the prism which exhibits an empty position (100). Thus, the plaques (1) can only slide where one of at least three and of at most four neighboring plaque positions is unoccupied (100). The possibility exists in this case to change from a selected side face of one part, for example (A), to the corresponding side face of the second part (B).

22 Claims, 6 Drawing Sheets

FIG. 2
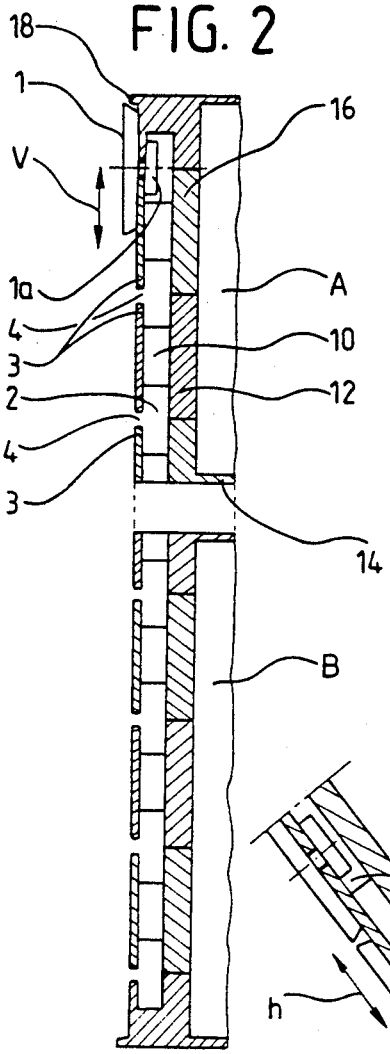
FIG. 1
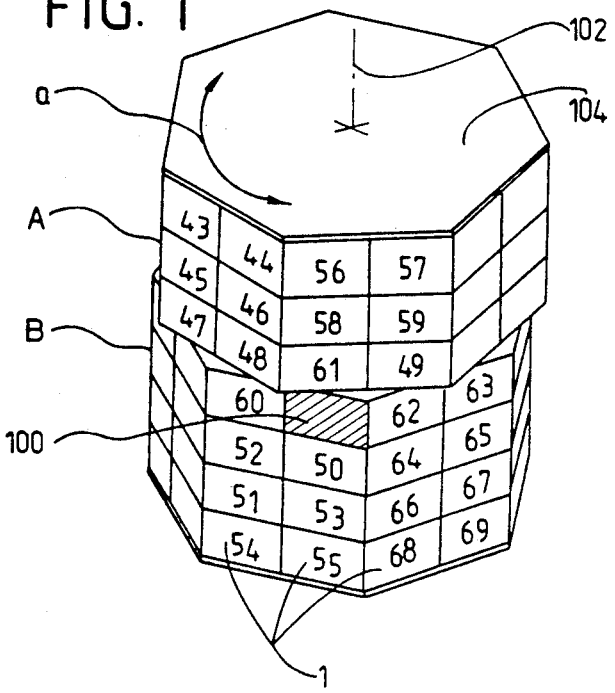
FIG. 3
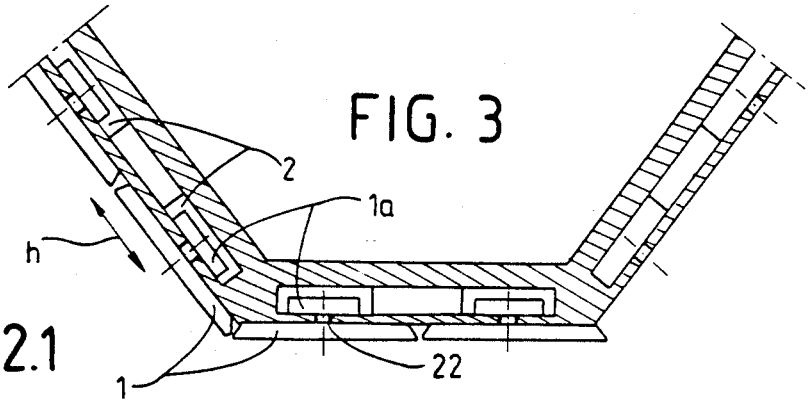
FIG. 2.1
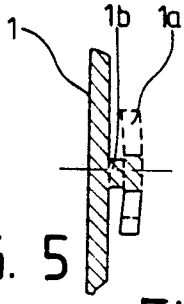
FIG. 5
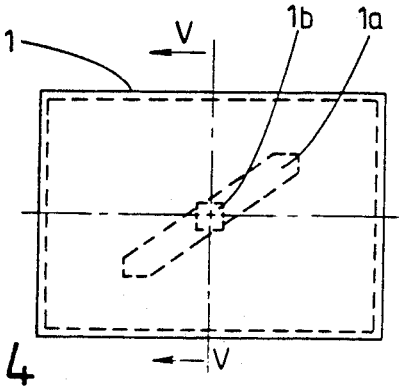
FIG. 4

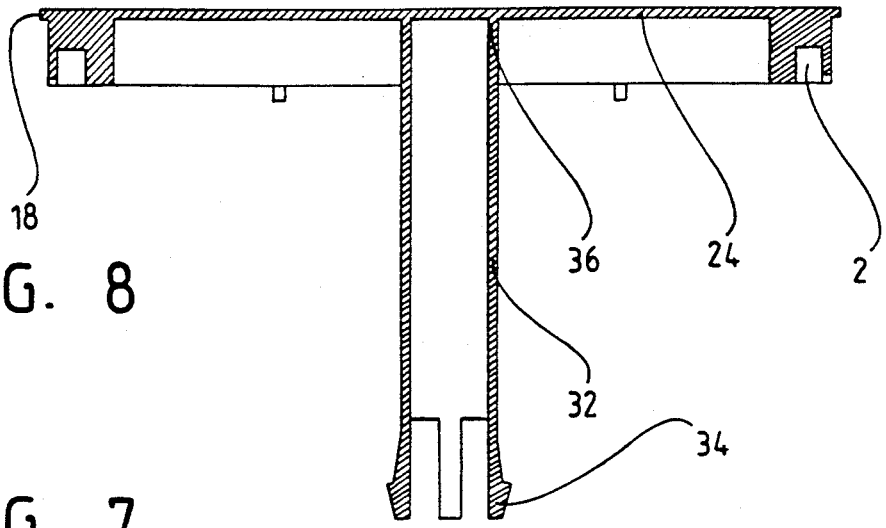
FIG. 8
FIG. 7
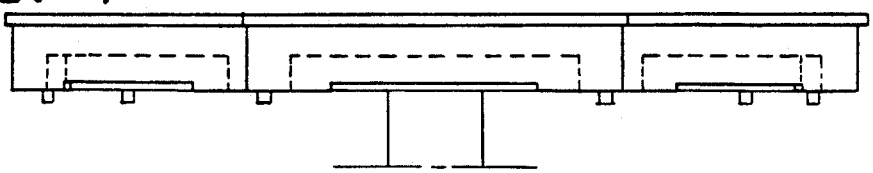
FIG. 6
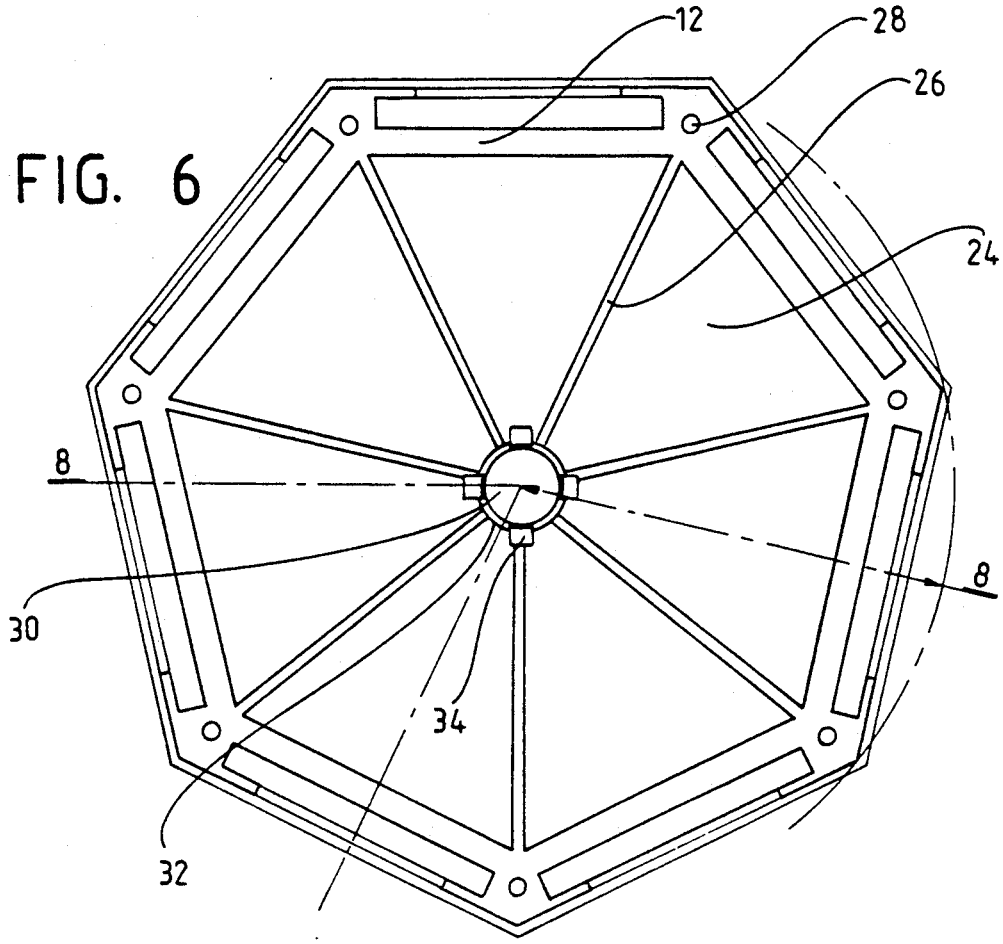

FIG. 17
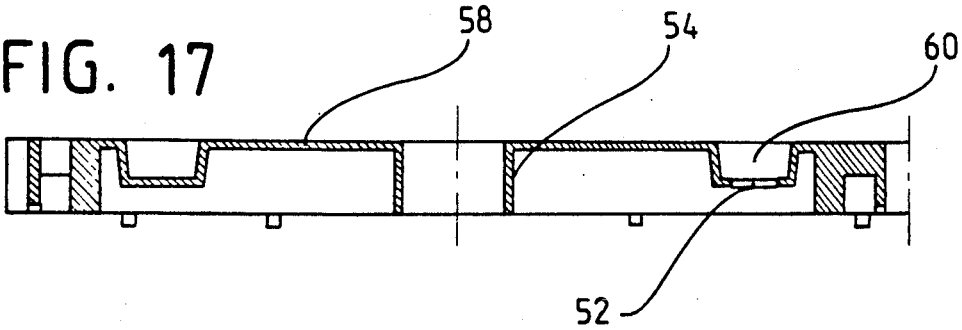
FIG. 16
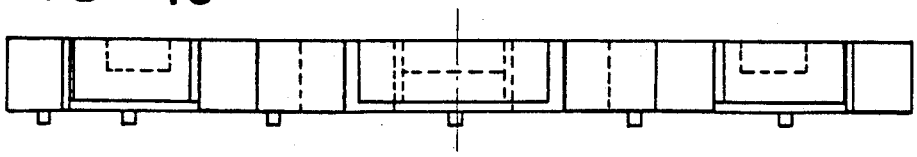
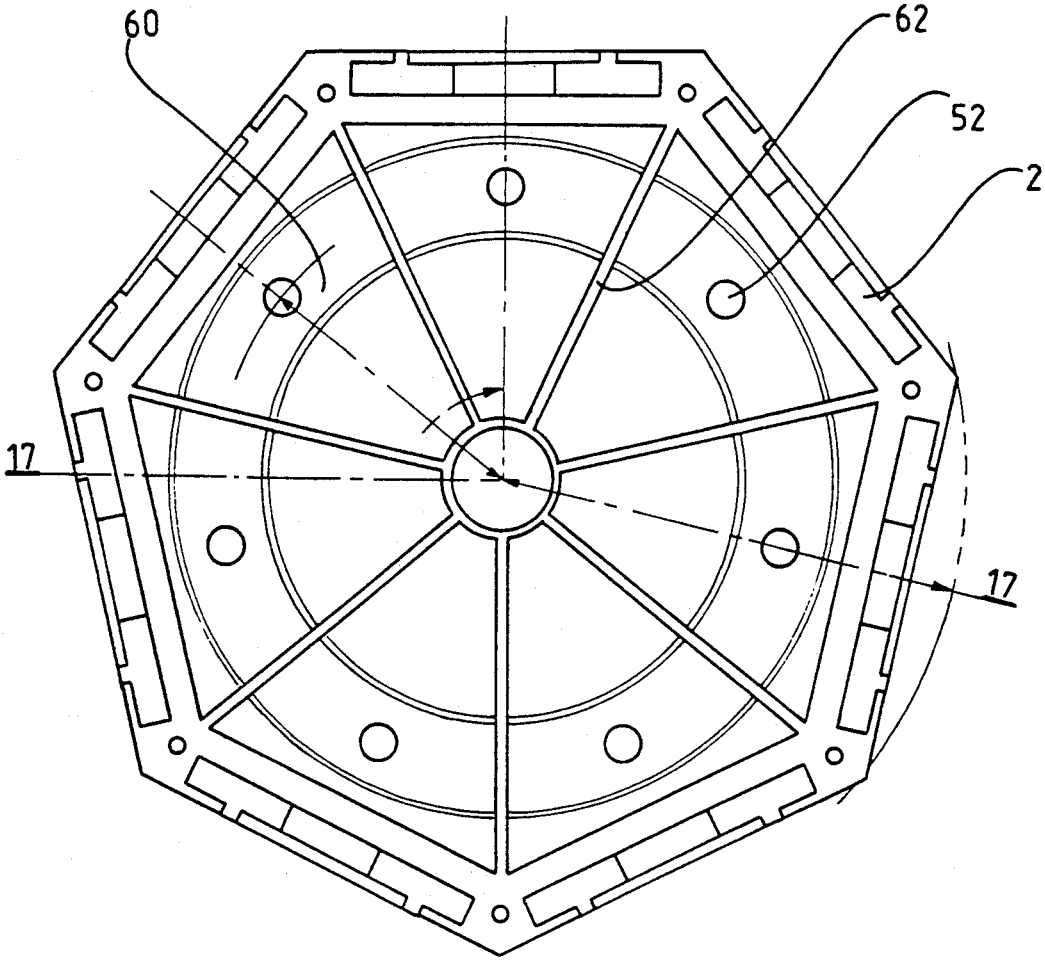
FIG. 15

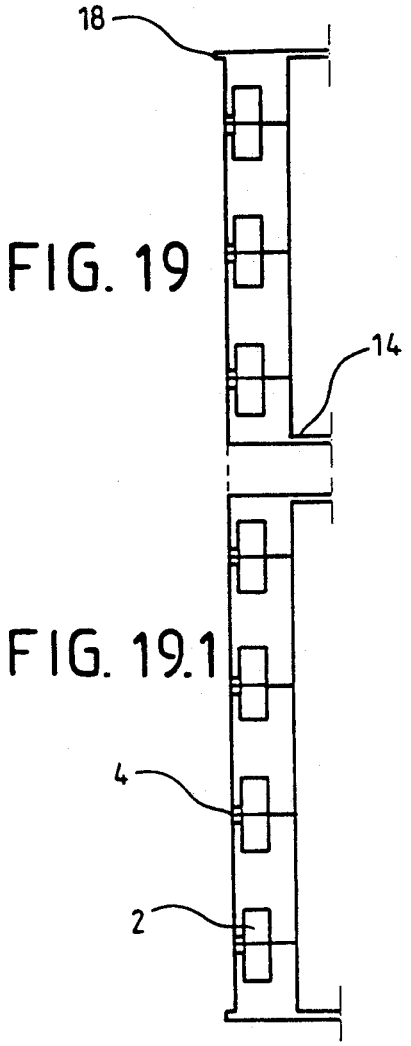
FIG. 19
FIG. 19.1
FIG. 18
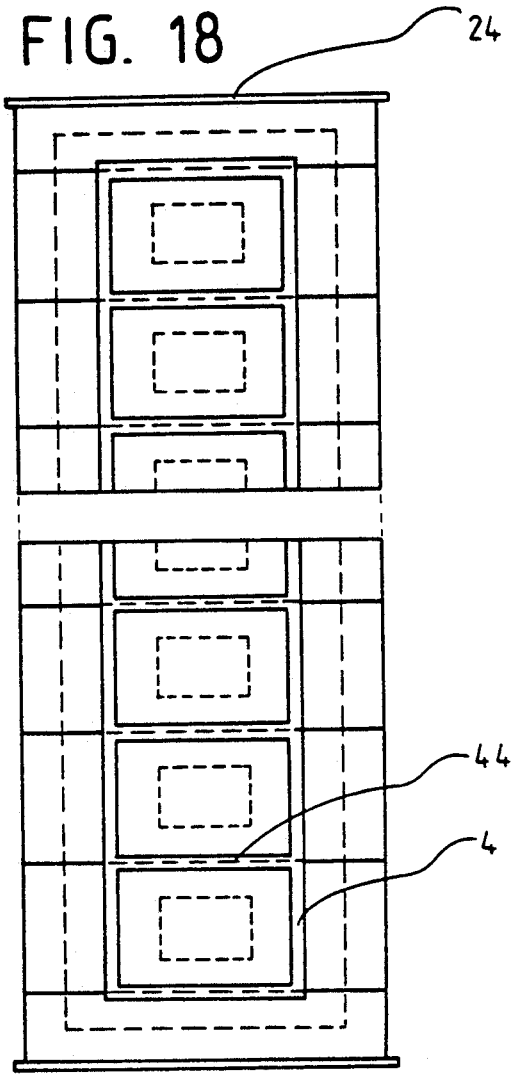
FIG. 18.1
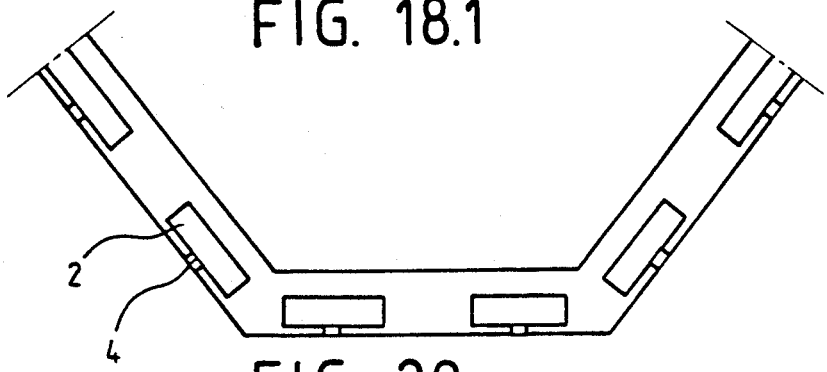
FIG. 20

THREE-DIMENSIONAL PUZZLE

CROSS-REFERENCE TO RELATED APPLICATIONS

This application is a continuation-in-part application of another application filed Dec. 7, 1989 and bearing Ser. No. 07/447,245. The entire disclosure of this latter application, including the drawings thereof, is hereby incorporated in this application as if fully set forth herein.

BACKGROUND OF THE INVENTION

1. Field of the Invention

The invention relates to a three-dimensional mechanical puzzle which is based on a body allowing a mutual shifting of elements.

2. Brief Description of the Background of the Invention Including Prior Art

Conventional puzzles such a Rubik's Cube contain simple colored elements which are positioned adjacent to neighboring elements, where the elements engage in such a way as to allow a shifting of disk configurations in three dimensions relative to each other. It is a disadvantage of the conventional construction that the visual orientation of the elements is not maintained during the shifting. Consequently, such structures are not suitable for a generation of visible patterns which go beyond a simplicity generated by the surface areas remaining invariant against the shifting.

SUMMARY OF THE INVENTION

1. Purposes of the Invention

It is an object of the present invention to furnish a mechanical, three-dimensional toy suitable for generation of various visual images.

It is another purpose of the present invention to furnish a structure which can serve educational purposes for small children without danger.

It is yet a further purpose of the invention to create a mechanical toy which is stimulating to the organizational and configurational sense of the player.

These and other objects and advantages of the present invention will become evident from the description which follows.

2. Brief Description of the Invention

The present invention provides for a puzzle device. An upper disk is configured to substantially exhibit an n-fold symmetry axis. A top cover covers the upper side of the upper disk. A first groove structure of the upper disk runs along the outer circumference of the upper disk exhibiting a substantially uniform width in a direction parallel to the symmetry axis. A second groove structure of the upper disk extends on an outer surface of the upper disk from the level of the first groove structure of the upper disk downward in a direction parallel to the symmetry axis. First attachment means of the upper disk are disposed on the bottom side of the upper disk. A middle disk is configured to substantially exhibit the n-fold symmetry axis. A first groove structure of the middle disk runs along the outer circumference of the middle disk exhibiting a substantially uniform width in a direction parallel to the symmetry axis. A second grove structure of the middle disk extends on an outer surface of the middle disk from the level of the first groove structure of the middle disk upward and downward in a direction parallel to the symmetry axis. First attachment means of the middle disk are disposed on the bottom side of the middle disk for rotatably attaching a disk to the bottom of the middle disk. Second attachment means of the middle disk are disposed on the top side of the middle disk to rotatably attach to the first attachment means of a disk disposed above the middle disk. A lower disk is configured to substantially exhibit the n-fold symmetry axis A bottom cover covers the lower side of the lower disk. A first groove structure of the lower disk runs along the outer circumference of the lower disk exhibiting a substantially uniform width in a direction parallel to the symmetry axis. A second grove structure of the lower disk extends on an outer surface of the lower disk from the level of the first groove structure of the lower disk upward in a direction parallel to the symmetry axis. Second attachment means of the lower disk are disposed on the top side of the lower disk to rotatably attach to the first attachment means of the middle disk disposed above the lower disk.

The first attachment means and the second attachment means can be centered around the symmetry axis. The first grooves can be disposed such that the distances between grooves on neighboring disks are substantially equidistant. The number of second grooves can be equal for all of the disks. The second grooves can be disposed such that the disks can be positioned such that all their respective second grooves form straight lines with second grooves disposed on adjoining disks.

The second grooves can be disposed such that they form pairs disposed in a plane disposed parallel to the symmetry axis and containing a pair of second grooves. Distances between neighboring grooves along the circumference of one of the disks can be substantially equidistant. The second grooves can be disposed such that at least one mirror plane, passing through the symmetry axis, is provided for each four second grooves of the disk, said mirror plane containing the symmetry axis.

A recess can be provided behind the groove surfaces. The recess can form a clamping and supporting structure for attaching elements to the puzzle structure by means of the grooves. Plaques can be slidably attached to the disks via the grooves. The recess can be of substantially rectangular cross section formed by a flat base in the disk, by two base elements protruding from the base, and by webs attached to the end of the protruding base elements.

The webs can have faces opposing the flat base and can be disposed substantially parallel to the flat base. The protruding base elements can have a surface forming a substantially right angle with the flat base and with the webs.

Plaques can be slidably attached to the disks via the grooves. The plaques can be formed of rectangular shape having a length corresponding substantially to the distance between grooves of the disks, which can be disposed in a direction parallel to the longitudinal direction of the rectangular shape, and having a width corresponding substantially to the distance between grooves of the disks, which can be disposed in a direction parallel to the width direction of the plaques.

The plaques can have their longitudinal direction disposed in a plane disposed perpendicular to the symmetry axis. The plaques can have a trapezoidal cross-section part forming an outside face in an attachment configuration relative to one of the grooves. Thereby, the outside of the plaque can form a base of a trapezoid with inner acute angles disposed at the corners at the ends of the base relative to sides of the trapezoid, having an acute angle from about 20 to 70 degrees, and followed by a back face of the plaque adjoining the sides of the trapezoid, having an inner angle with the sides of from about 110 to 160 degrees.

The plaques can have a rear pin disposed about at the center of the back face of the plaque and an extension of from about 1 to 1.2 times the thickness of a support piece attached to a respective disk. The rear pin of the plaques can have a locking element attached for lockingly engaging the grooves of the disks and can be formed of a wing structure with two wings. Said wing structure can be directed oppositely relative to the position of the pin and can extend substantially parallel to a diagonal direction of the rectangular plaque.

The wings can each have a length of from about 0.1 to 0.4 times, or preferably 0.2 to 0.3 times, the diagonal length of the plaque. The wings can be angled by at least about 2 to 5 degrees, relative to the back face of the plaque such that the ends of the wings can be disposed closer to the plaque than the portion of the wings adjoining the pin for lockingly engaging the grooves.

The invention structure can comprise at least two additional middle disks having the same structure as the middle disk. These additional middle disks can be disposed between the upper disk and the lower disk and can form a sequential structure together with the upper disk, the lower disk, and the middle disk.

A shaft can be attached to a first one of the covers and can extend towards the middle element, disposed centered around the symmetry axis. The shaft can have a locking element disposed at its end to engage a matching locking element disposed at the second one of the covers for securing the relative position of upper disk, middle disk, and lower disk. Radial reinforcement ribs can be disposed on the disks for enhancing the structural stability of the disks. Circular guide elements can be disposed on a horizontal face of a disk and matching circular guide elements can be disposed at an opposing horizontal face of a second disk. This can enhance the relative positional stability of the disks and allow a stable rotary sliding motion of the two disks relative to each other. Locking means can be disposed on a horizontal face of a disk and matching engaging locking elements can be disposed at an opposing horizontal face of a second disk for stabilizing certain defined mutual positions of the first and of the second disk. The defined mutual positions can correspond to a relative position of the neighboring disks. A vertical projection of the two disks can result in a coinciding of the projections of the grooves of the two disks disposed in parallel to the symmetry axis.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 shows a perspective view of a three-dimensional puzzle with a part A of the prism slightly turned versus a second part B, and with plaques with numerals, which can be arranged, for example, in a progressive sequence;

FIG. 2 is a sectional longitudinal view of an upper a part of the side wall of the prism according to FIG. 1;

FIG. 2.1 is a sectional longitudinal view of a lower part of the corresponding to FIG. 2 side wall of the prism according to FIG. 1;

FIG. 3 is a horizontal planar sectional view of part of the side wall of the prism according to FIG. 1;

FIG. 4 is a view of the front side of a plaque 1;

FIG. 5 is a cross-sectional view through the plaque illustrated in FIG. 1, along section line V—V, FIG. 6 is a bottom view of a top circumferential element, FIG. 7 is a side elevational view of the embodiment of FIG. 6, FIG. 8 is a sectional view of the embodiment of FIG. 6 along section lines 8—8, FIG. 15 is an embodiment structured for matching the embodiment of FIG. 12, including hole catches, FIG. 16 is a side elevational view of the embodiment of FIG. 15, FIG. 17 is a cross-sectional view of the embodiment of FIG. 15, along section lines 17—17, FIG. 18 is a sectional longitudinal view of an upper part of the prism of the embodiment of FIG. 1 after removal of the plaques, FIG. 18.1 is a sectional longitudinal view of the lower part corresponding to FIG. 18 of the prism of the embodiment of FIG. 1 after removal of the plaques, FIG. 19 is a sectional longitudinal view of an upper part of the side wall of the embodiment of FIG. 1 after removal of the plaques, FIG. 19.1 is a sectional longitudinal view of a lower part of the side wall corresponding to FIG. 19 of the embodiment of FIG. 1 after removal of the plaques.

FIG. 20 is a horizontal planar sectional view of part of the side wall of the embodiment of FIG. 1 after removal of the plaques.

DESCRIPTION OF INVENTION AND PREFERRED EMBODIMENT

Figure 11:
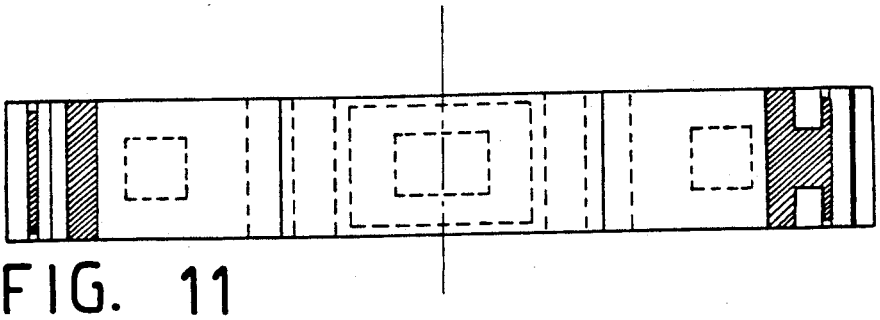
FIG. 11 is a cross-sectional view of the embodiment of FIG. 9, along section lines 11—11.

According to the present invention, a three-dimensional puzzle, as illustrated in FIG. 1, extends over and involves the side faces of an upright disposed prism structure with a polygonal base face. Said prism structure is composed of at least two parts A, B, which are rotatable relative to each other around a coaxial direction. The rotation a can be performed by hand and can be performed in the two possible opposite rotation directions. Each matching position of the side faces is marked by a locking engagement between the parts A and B. Plaques 1, slidable in direction of arrows v (FIG. 2), h (FIG. 3), are disposed on each side face in a vertical double row. Said plaques 1 cover the full side face of the puzzle disposed parallel to the cylinder axis 102 of the puzzle. These plaques 1 exhibit on their back side elastic wings 1*a* extending and protruding from a connection pin 1*b* disposed in the center of the plaque 1. The plaques 1 are slidable at the side faces of the prism in a vertical direction v and/or horizontal direction h and are held in position with the elastic wings 1*a* guided in guide grooves 2. In fact, the plaques 1 and elastic wings la are slidable to that side face of the prism, which just exhibits an empty position 100 (FIG. 1). Thus, the plaques can only slide where one of at least three and of at most four neighboring plaque positions is unoccupied (100). The possibility exists in this case to change from a selected side face of one part, for example A, to the corresponding side face of the second part B.

A turning of part A versus the part B thus allows that a plaque 1 from any desired side face of one part of the prism can be slid or rotated onto any desired side of the adjoining rotatable part where such plaque position is unoccupied (100).

The plaques slidable in direction h, v can exhibit on the outer, visible face representations, letters, numerals, colors, and the like. These plaques can further be disposed on the various side face in a logical, alphabetical, arithmetic, chromatic, or any other sequence by rotating the parts A, B and sliding of the plaques along various side faces.

The puzzle preferably exhibits an overall symmetry which is a rotation symmetry around a rotation axis, where the symmetry axis can be two-fold, three-fold, four-fold, five-fold, six-fold, seven-fold, eight-fold, nine-fold, ten-fold, eleven-fold, or a twelve fold axis, for example. The axis can be further a full-rotation symmetric n-fold axis, where the outer faces are planar faces corresponding in number respective to a cross-section perpendicular to the n-fold axis to the multiplicity n of the symmetry axis. Alternatively, the outer faces can be curved such that a circular cylinder results, which circular cylinder is subdivided into a number of fields.

According to FIG. 2, the side wall of the prism is subdivided in a support structure 16 and in plaques 1, which are slidably mounted on the support structure 16. These plaques 1 are preferably of a uniform rectangular structure in projection. They include a central connection pin 1*b* which pin 1*b* is preferably disposed at the center of the rectangular plaque on the rear side, remote from the visible surface. At the end of the pin 1*b*, there is disposed an elastic guide wing 1*a*. The guide wing 1*a* is preferably an elongated plate, where the elongation direction is disposed toward two opposite corners of the rectangle. The guide wings 1*a* are disposed preferably with their face in parallel to the face of the plaque 1. The length of the wings can be from about 0.3 to 0.7, and is preferably from about 0.4 to 0.6, of the distance between opposed corners of the rectangle. The width of the wing 1*a* can be from about 0.5 to 3.0 times, and preferably from about 1.0 to 2.0 times, the width of the connection pin. Preferably, the connection pin has a rectangular shape which is matched to the shape of slots provided as guides for the connection pin 1*b* in the plaque 1. The support structure 16 contains base elements 10, which contain at the areas of joining plaques, as seen in axial direction, extensions 14 for better maintaining alignment and mutual shifting of the base elements. The base elements 10 have attached support webs 3 which are rigidly mounted to the base plates 12. In turn, webs 3 are attached to the base element 10 in a fixed position. Each base element 10 is disposed such that at least on one side thereof there is formed a vertically elongated gap 4 for guiding the plaques 1, the pins 1*b* and the wings 1*a*. The width of the base element 10 can be from about 0.3 to 0.7 times the respective width of the plaques, and is preferably from about 0.4 to 0.6 times the respective width of the plaques. The width of the webs 3 is preferably such that the connection pins can slide in between two neighboring webs 3. The thickness of the elastic connection wing is preferably from about 0.3 to 0.8 of the thickness of the support piece 10, and is preferably 0.5 to 0.7 times the thickness of the base element 10.

As illustrated in FIG. 5, the wings 1*a* are preferably constructed of an elastic material such that the distance of the end of the wings 1*a* toward the plaque 1 is less than the width of the wings 1*a* in the neighborhood of the connection pin 1*b* in an unclamped rest position. The difference in distance between the wing 1*a* and plaque 1 at the end position and the distance wing 1*a* and plaque 1 at a position close to the connection pin 1*b* can be from about 1 to 20% and is preferably between 2 and 5% of the thickness of the wing.

The plaque 1 can have a trapezoidal cross-section as seen in FIGS. 2 and 3, where the trapezoid is a symmetrical trapezoid with the larger base facing the outside and with the smaller or shorter base disposed close to the slots for the connection pin 22. The angle for the side faces of the trapezoid can be from about 40 to 70 degrees and is preferably between 50 and 60 degrees. The size of the outer faces of the plaques is dimensioned such that there is left a small space between these elements for avoiding interference with the sliding and this small distance can be from about 1/10 to 1/100 of the respective width of the plaque 1 and is preferably from 2/100 to 5/100 of the respective width of the plaque 1.

End webs 18 can be provided which are disposed at the uppermost and lowermost element of the structure for providing a smooth connection, e.g. of an upper row plaque 1, to the top cover 104 of the puzzle and for protecting the upper edges of the uppermost and the lower edges of the lowermost plaque.

FIG. 6 illustrates the bottom view of the top-plate circumferential element. The circumferential element comprises a top face 24 and reinforcing profiles or rods 26. Pinion joints 28 between the elements are disposed near the circumferential corners of the circumferential element. A center covering 30 can be provided above a shaft 32 in the center of the top plate circumferential element. The shaft 32 ends in locking elements 34 disposed at the end of the shaft 32. Preferably, the shaft 32 is adjoined to the top face 24 at positions 36 without interruption of the top face 24. Preferably, the locking elements 34 of increased thickness of from about 2 to 4 times the thickness of the shaft 32 in order to provide for engagement. The further peripheral base plates 12 are furnished for reinforcement and to provide additional stability to the structure.

Figure 9:
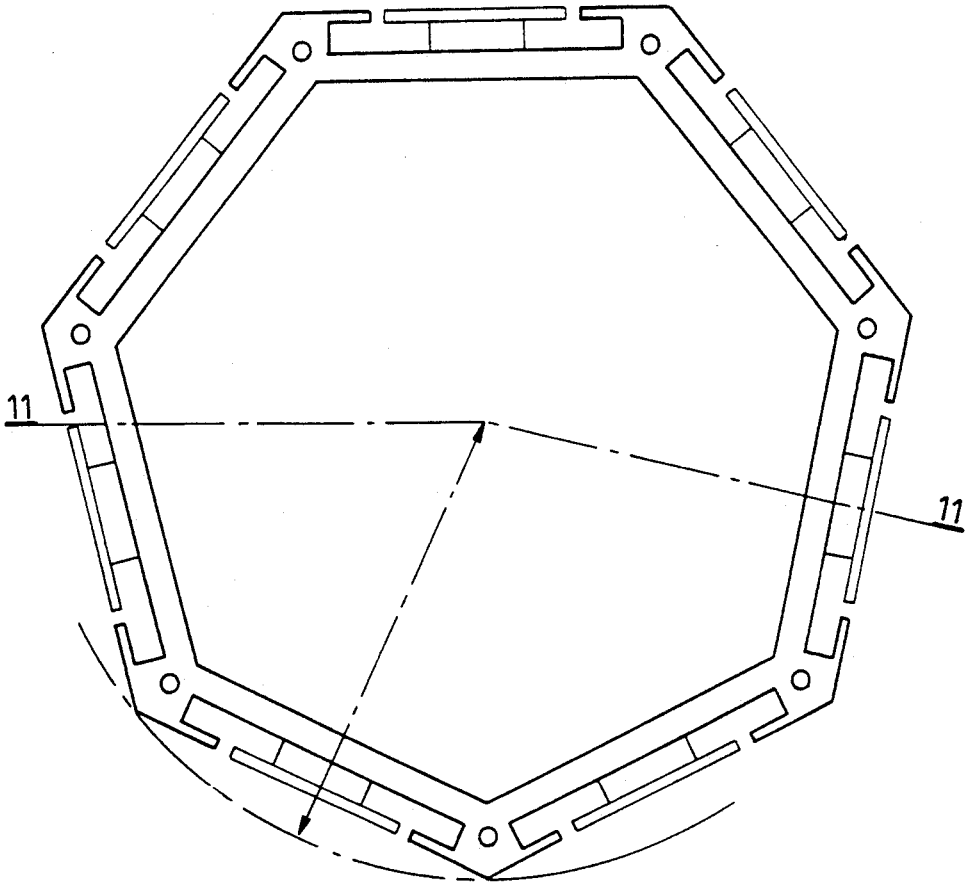
FIG. 9 is a cross-section of an inner disposed circumferential element.

FIG. 9 illustrates a similar structure as that of FIG. 6, however, only the circumferential area is present in this section and not the top face. Also, the positioning element around the shaft is not illustrated. The embodiment of FIGS. 9 to 11 illustrates the organization of the support for the plaques around the invention structure.

Figure 14:
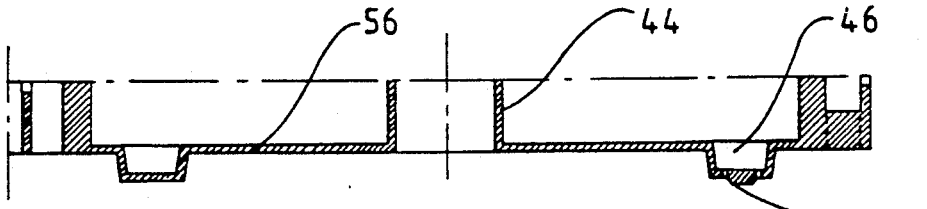
FIG. 14 is a cross-sectional view of the embodiment of FIG. 12, along section lines 14—14.
Figure 12:
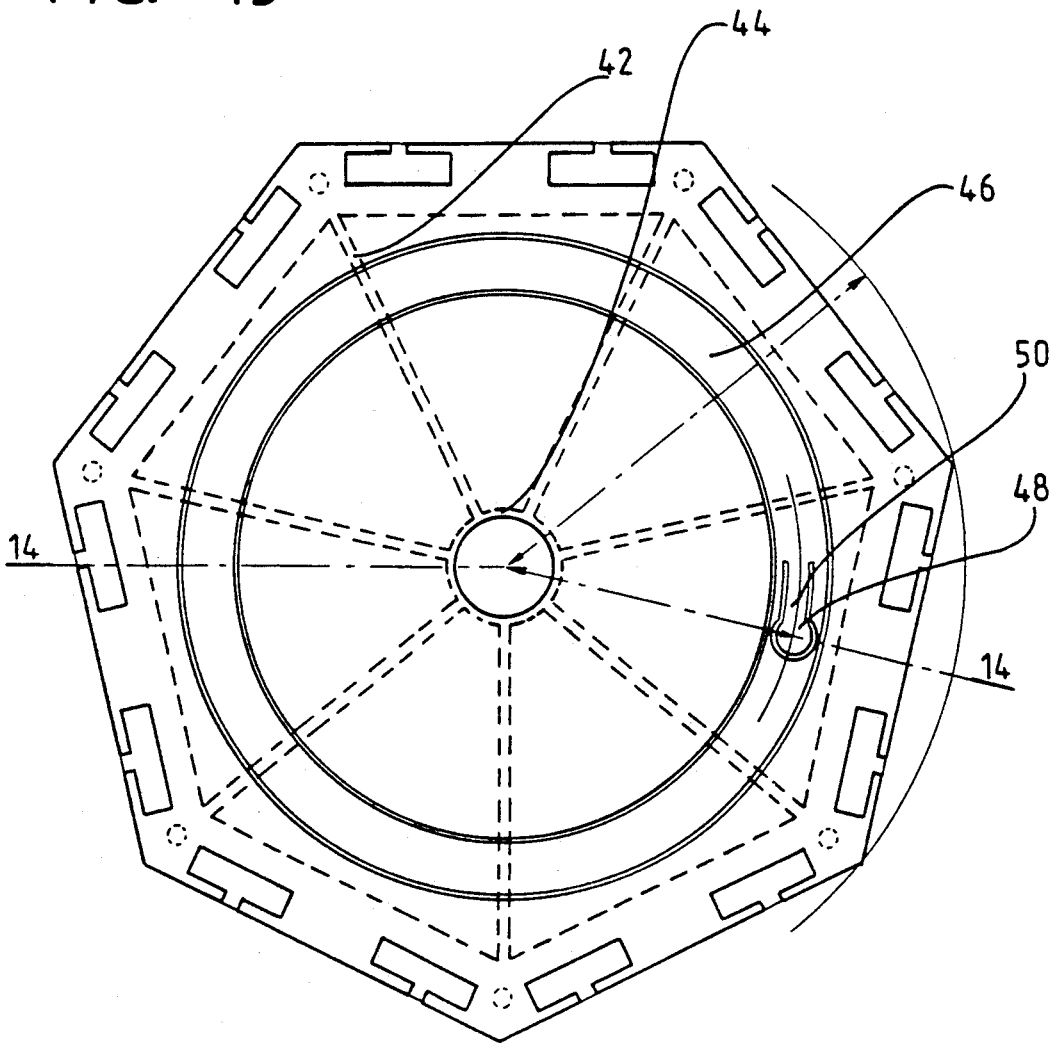
FIG. 12 is a bottom view of a second embodiment of a middle circumferential element.

In comparison, FIG. 12 shows an upper part of an element shown in FIG. 11. The reinforcing elements 42 furnished as strengthening profiles and a shaft-surrounding (32) reinforcement ring 44 can be recognized. There is further a groove 46 provided near the periphery which is of annular shape and which runs over the full circumference of the circumferential element. The groove 46 comprises a locking element 48 which is suitable to engage by a clicking or clamping mechanism. According to FIGS. 12 and 14, the locking element 48 is formed by a partly cut-out tongue 50 fitted to the groove 46 and by forming the tongue 50 such that a locking element 48 is created which protrudes in its normal position downwardly as illustrated in FIG. 14. The reinforcement ring 44 fixes the position with respect to the shaft 32 illustrated in FIG. 8.

Figure 10:
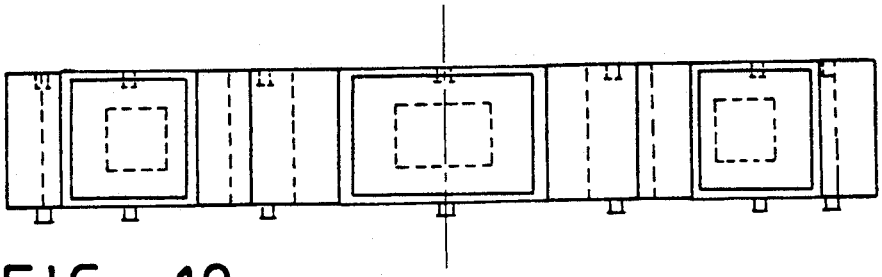
FIG. 10 is a side elevational view of the embodiment of FIG. 9.
Figure 13:
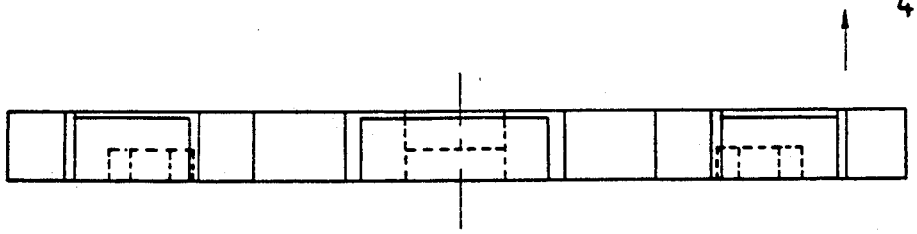
FIG. 13 is a side elevational view of the embodiment of FIG. 12.

FIGS. 15–17 show an element which complements the elements of FIGS. 12–14 to provide the structure required according to FIGS. 9–11. As a counterpoint to the locking element 48, there are provided hole catches 52, which are adapted to be engaged by the locking element 48 and thereby fixing seven different relative positions between the circumferential element of FIGS. 12 and 15. Again, a shaft section 54 is provided in this embodiment. The reinforcing planar part of FIG. 14 is designated with 56 and this planar part 56 comes to rest under normal conditions against a planar part 58 of the embodiments of FIGS. 12–14. A gliding track line 60 engages the outside of the groove 46. Tongue dial stiffening elements 62 are provided for additional stability of the structure. The small grooves 2 for allowing a sliding can be recognized in FIG. 18.

FIG. 18 illustrates a side view of the assembled structure which allows to recognize sliding possibilities of plaques 1 in case the structure circumferential elements are aligned along the shaft axis. The plaques can slide along the vertically elongated gaps 4 and along the horizontally elongated gaps 44. It is seen that in such an aligned position, the plaque elements have the possibilities to move in upward and downward direction up to the uppermost circumferential element and down to the lowermost circumferential element and they have the possibility to move either to the right or to the left, depending on the respective position and depending on prior provision of a respective neighboring unoccupied position 100.

It will be understood that each of the elements described above, or two or more together, may also find a useful application in other types of puzzles differing from the types described above.

While the invention has been illustrated and described as embodied in the context of three-dimensional puzzles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A puzzle device comprising an upper disk exhibiting a symmetry axis disposed perpendicular to a disk plane;

a top cover covering an upper side of the upper disk;

a first groove structure of the upper disk running along an outer circumference of the upper disk exhibiting a uniform width measured in a direction parallel to the symmetry axis;

a second groove structure of the upper disk extending in a direction perpendicular to the disk plane on an outer surface of the upper disk from a level of the first groove structure of the upper disk in a direction parallel to the symmetry axis;

first attachment means of the upper disk disposed on a bottom side of the upper disk;

a middle disk exhibiting the symmetry axis;

a first groove structure of the middle disk running along an outer circumference of the middle disk exhibiting a uniform width in a direction parallel to the symmetry axis;

a second groove structure of the middle disk extending in upward direction and in downward direction on an outer surface of the middle disk from the level of the first groove structure of the middle disk in a direction parallel to the symmetry axis;

first attachment means of the middle disk disposed on a bottom side of the middle disk for rotatably attaching a disk to the bottom of the middle disk;

second attachment means of the middle disk disposed on a top side of the middle disk to rotatably attach to the first attachment means of a disk disposed above the middle disk;

a lower disk exhibiting the symmetry axis;

a bottom cover covering a lower side of the lower disk;

a first groove structure of the lower disk running along an outer circumference of the lower disk exhibiting a uniform width in a direction parallel to the symmetry axis;

a second groove structure of the lower disk extending in upward direction on an outer surface of the lower disk from the level in the first groove structure of the lower disk in a direction parallel to the symmetry axis;

second attachment means of the lower disk disposed on a top side of the lower disk to rotatably attach to the first attachment means of the middle disk disposed above the lower disk;

a recess is provided behind the groove surfaces, wherein the recess forms a clamping and supporting structure for attaching elements to the puzzle structure by means of the groove structures;

plaques to be slidably attached to the disks via the groove structures.

2. The puzzle device according to claim 1 wherein the first attachment means and the second attachment means are centered around the symmetry axis;

wherein a positioning of the first groove structure in one disk is identical to a positioning of the first groove structure in any adjoining disk, and wherein the spacing between respective groove structures is identical between respective adjoining disks;

wherein the number of second groove structures are equal for all of the disks;

wherein a positioning of the second groove structures in the disks is such that all their respective second groove structures can form straight lines with second groove structures disposed on adjoining disks.

3. The puzzle device according to claim 1 wherein second groove structures are arranged in pairs in a plane parallel to the symmetry axis of a disk.

4. The puzzle device according to claim 3 wherein distances between groove structure pairs along the circumference of any of the disks are equidistant.

5. The puzzle device according to claim 1 wherein the second groove structures are disposed such that at least one plane, passing through the symmetry axis, is provided for each four second groove structures of the disk, said plane containing the symmetry axis.

6. The puzzle device according to claim 1 wherein the recess is rectangular and is formed by a flat base in the disk, by two base elements protruding from the flat base, and by webs attached to the end of the protruding base elements.

7. The puzzle device according to claim 6 wherein the webs have faces opposing the flat base and disposed parallel to the flat base, and wherein the protruding base elements have a surface forming a right angle with the flat base and with the webs.

8. The puzzle device according to claim 1 further comprising at least two additional middle disks having a same structure as the middle disk and disposed between the upper disk and the lower disk and forming a sequential structure together with the upper disk, the lower disk, and the middle disk.

9. The puzzle device according to claim 1 further comprising a shaft attached to a first one of the covers and extending towards the middle element, disposed centered around the symmetry axis and having a locking element disposed at its end to engage a matching locking element disposed at a second one of the covers for securing the relative position of upper disk, middle disk, and lower disk;

radial reinforcement ribs disposed on the disks for enhancing the structural stability of the disks;

circular guide elements disposed on a horizontal face of a disk and matching circular guide elements disposed at an opposing horizontal face of a second disk for enhancing the relative positional stability of the disks and for allowing a stable rotary sliding motion of the two disks relative to each other;

locking means disposed on a horizontal face of a disk and matching engaging locking elements disposed at an opposing horizontal face of a second disk for stabilizing certain defined mutual positions of the first and of the second disk, and wherein the defined mutual positions correspond to a relative position of the neighboring disks, wherein a vertical projection of the two disks results in a coinciding of the projections of the groove structures of the two disks disposed in parallel to the symmetry axis.

10. The puzzle device according to claim 1 wherein plaques are formed of rectangular shape having a length corresponding to a distance between the groove structures of the disks, which can be disposed in a direction parallel to a longitudinal direction of the rectangular shape, and having a width corresponding to the distance between the groove structures of the disks, which can be disposed in the direction parallel to a width direction of the plaques.

11. The puzzle device according to claim 10 wherein the plaques have a trapezoidal cross-section part forming an outside face in an attachment configuration relative to one of the grooves such that the outside face of the plaque forms a base of a trapezoid with inner acute angles disposed at corners at the ends of the base relative to sides of the trapezoid having an acute angle from about 20 to 70 degrees and followed by a back face of the plaque adjoining the sides of the trapezoid having an inner angle with the sides of from about 110 to 160 degrees.

12. A puzzle device comprising an upper disk exhibiting an symmetry axis disposed perpendicular to a disk plane;

a top cover covering an upper side of an upper disk;

a first groove structure of the upper disk running along an outer circumference of the upper disk exhibiting a uniform width measured in a direction parallel to the symmetry axis;

a second groove structure of the upper disk extending in a direction perpendicular to the disk plane on an outer surface of the upper disk from a level of the first groove structure of the upper disk in a direction parallel to the symmetry axis;

first attachment means of the upper disk disposed on a bottom side of the upper disk;

a middle disk exhibiting the symmetry axis;

a first groove structure of the middle disk running along an outer circumference of the middle disk exhibiting a uniform width in a direction parallel to the symmetry axis;

a second groove structure of the middle disk extending in upward direction and in downward direction on an outer surface of the middle disk from the level of the first groove structure of the middle disk in a direction parallel to the symmetry axis;

first attachment means of the middle disk disposed on a bottom side of the middle disk for rotatably attaching a disk to the bottom of the middle disk;

second attachment means of the middle disk disposed on a top side of the middle disk to rotatably attach to the first attachment means of a disk disposed above the middle disk; a lower disk exhibiting the symmetry axis;

a bottom cover covering a lower side of the lower disk; a first groove structure of the lower disk running along an outer circumference of the lower disk exhibiting a uniform width in a direction parallel to the symmetry axis;

a second groove structure of the lower disk extending in upward direction on an outer surface of the lower disk from the level of the first groove structure of the lower disk in a direction parallel to the symmetry axis;

second attachment means of the lower disk disposed on a top side of the lower disk to rotatably attach to the first attachment means of the middle disk disposed above the lower disk;

wherein a recess is provided behind the groove surfaces, and wherein the recess forms a clamping and supporting structure for attaching elements to the puzzle structure by means of the groove structures;

wherein the recess is rectangular formed by a flat base in the disk, by two base elements protruding from the flat base, and by webs attached to an end of the protruding base elements;

wherein the webs have faces opposing the flat base and disposed parallel to the flat base, and wherein the protruding base elements have a surface forming a right angle with the flat base and with the webs;

further comprising:

plaques to be slidably attached to the disks via the groove structures.

13. The puzzle device according to claim 12 wherein the plaques are formed of rectangular shape having a length corresponding to a distance between groove structures of the disks, which plaques can be disposed in a direction parallel to a longitudinal direction of the rectangular shape, and having a width corresponding to the distance between groove structures of the disks, which plaques can be disposed in a direction parallel to a width direction of the plaques.

14. The puzzle device according to claim 13 wherein the plaques have their longitudinal direction disposed in a plane disposed perpendicular to the symmetry axis.

15. The puzzle device according to claim 11 wherein each plaque has a trapezoidal part forming an outside face and an attachment structure engaging and sliding in the groove structures such that an outer face of the plaque forms a base of a trapezoid with inner acute angles disposed at the corners at the ends of the base relative to sides of the trapezoid having an acute angle from about 20 to 70 degrees and followed by a back face of the plaque adjoining the sides of the trapezoid having an inner angle with the sides of from about 110 to 160 degrees.

16. The puzzle device according to claim 15 wherein the plaques have a rear pin disposed about at the center of the back face of the plaque and having an extension of from about 1 to 1.2 times a thickness of a support piece attached to a respective disk.

17. The puzzle device according to claim 15 wherein the rear pin of the plaques has attached a locking element for lockingly engaging the groove structures of the disks.

18. The puzzle device according to claim 17 wherein the wings have each a length of from about 0.1 to 0.4 times the diagonal length of the plaque.

19. The puzzle device according to claim 17 wherein the wings have each a length of from about 0.2 to 0.3 times the diagonal length of the plaque.

20. The puzzle device according to claim 17 wherein the wings are angled by at least about 2 degrees relative to a back face of the plaque such that the ends of the wings are disposed closer to the plaque than a portion of the wings adjoining the pin for lockingly engaging the groove structures.

21. The puzzle device according to claim 17 wherein the wings are angled by at least about 5 degrees relative to the back face of the plaque such that the ends of the wings are disposed closer to the plaque than the portion of the wings adjoining the pin for lockingly engaging the groove structures.

22. The puzzle device according to claim 15 wherein the rear pin of the plaques has attached a locking element for lockingly engaging the groove structures of the disks and formed of a wing structure with two wings directed oppositely relative to the position of the pin and extending parallel to a diagonal direction of the rectangular plaque.

* * * * *